US006250736B1

(12) United States Patent
Wojcik

(10) Patent No.: US 6,250,736 B1
(45) Date of Patent: Jun. 26, 2001

(54) CONTINUOUS INK JET PRINT HEAD WITH FIXED POSITION INK GUTTER COMPATIBLE WITH HYDRODYNAMIC AND WIPE CLEANING

(75) Inventor: Timothy J. Wojcik, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/366,819

(22) Filed: Aug. 4, 1999

(51) Int. Cl.[7] ..... B41J 2/165
(52) U.S. Cl. ..... 347/33; 347/28; 347/36
(58) Field of Search ..... 347/33, 28, 36

(56) References Cited

U.S. PATENT DOCUMENTS

| | | | |
|---|---|---|---|
| 4,015,272 | 3/1977 | Yamamori et al. | 347/68 |
| 4,417,259 | 11/1983 | Maeda | 347/31 |
| 4,543,591 | 9/1985 | Terasawa | 347/30 |
| 4,571,601 | 2/1986 | Teshima | 347/33 |
| 4,577,203 | 3/1986 | Kawamura | 347/30 |
| 4,600,931 | 7/1986 | Terasawa | 347/30 |
| 4,745,414 | 5/1988 | Okamura et al. | 347/30 |
| 4,800,403 | 1/1989 | Accattino et al. | 347/30 |
| 4,829,318 | 5/1989 | Racicot et al. | 347/33 |
| 4,855,764 | 8/1989 | Humbs et al. | 347/31 |
| 4,870,341 | 9/1989 | Pihl et al. | 324/600 |
| 4,959,673 | 9/1990 | Noda | 347/33 |
| 4,968,994 | 11/1990 | Hock et al. | 347/28 |
| 4,970,534 | 11/1990 | Terasawa et al. | 347/32 |
| 4,970,535 | 11/1990 | Oswald et al. | 347/25 |
| 5,084,712 | 1/1992 | Hock et al. | 347/28 |
| 5,184,147 | 2/1993 | MacLane et al. | 347/30 |
| 5,202,702 | 4/1993 | Terasawa et al. | 347/32 |
| 5,644,345 * | 7/1997 | Toniolo | 347/32 |
| 5,815,176 * | 9/1998 | Rotering | 347/33 |
| 5,997,128 * | 12/1999 | Lou et al. | 347/33 |

FOREIGN PATENT DOCUMENTS

| | | | |
|---|---|---|---|
| 3825045 * | 1/1990 | (DE) | 347/28 |
| 56-144162 * | 11/1981 | (JP) | 347/28 |
| 36201352 * | 1/1987 | (JP) | 347/28 |

* cited by examiner

*Primary Examiner*—N. Le
*Assistant Examiner*—Shih-Wen Hsieh

(57) ABSTRACT

An ink jet printer maintenance or cleaning system (10) for continuous ink jet printing systems having an ink collecting gutter (12) on the print head (12, 46). The maintenance or cleaning system (10) generally comprises a hydrodynamic cleaning fluid nozzle (24) disposed within the print head (12, 46), a wiper (26, 52) for engaging the print head (12, 46), and a spittoon (28, 66) for collecting discharged cleaning fluid. Relative translational movement between the wiper (26, 52) and the print head (12, 46), along with a discharge of cleaning fluid from the hydrodynamic cleaning fluid nozzle (24), cleans the ink nozzle (18) of the print head (12, 46). In a preferred embodiment, the wiper (26, 52) is disposed on the spittoon (28), which is positioned along one end of the guide shafts (16*a*, 16*b*) such that movement of the print head (12) over the spittoon (28) causes the wiper (26) to engage the print head (12) and clean the ink nozzle (18). In an alternate embodiment, the wiper (52) is disposed on a wiper shuttle (44) that is slidably attached to the print head (44). As the print head (44) moves over the spittoon (66), a pair of pins (56*a*, 56*b*) along with a corresponding pair of mechanical stops (64*a*, 64*b*), causes the print head (44) to move relative to the wiper (52), thereby cleaning the print head (44).

23 Claims, 3 Drawing Sheets

CONTINUOUS INK JET PRINT HEAD WITH FIXED POSITION INK GUTTER COMPATIBLE WITH HYDRODYNAMIC AND WIPE CLEANING

FIELD OF THE INVENTION

This invention pertains generally to continuous ink jet printing systems, and more particularly to a system for cleaning and maintaining continuous ink jet print heads.

BACKGROUND OF THE INVENTION

Ink jet printing systems require frequent maintenance and cleaning due to an accumulation of paper powder, dust, or ink of increased viscosity on and adjacent the printing nozzles of the print head. In continuous ink jet printing systems, a gutter disposed adjacent the printing nozzles is used to collect for recycling the ink not being directed to the print media. The unused ink is trapped by the gutter and directed through an ink recycling slot or channel within the print head.

In order for the gutter to effectively capture the unused ink for recycling, the gutter resides partially between the printing nozzles and the print media, which is typically paper or the like. This positioning of the gutter, while functional, causes difficulties in maintenance and cleaning of continuous ink jet printing systems, which require hydrodynamic and wipe cleaning, since the gutter partially restricts access for cleaning mechanisms and fluids from easily reaching the printing nozzles on the print head. As a result, during print head maintenance and cleaning operations, the gutter must be removed. This is an inefficient, time consuming process, and is difficult to implement cost effectively and reliably due to the required positional accuracy.

Therefore, there exists a need for a print head maintenance and cleaning system that allows hydrodynamic and wipe cleaning of the printing nozzles on the print head without the necessity of removing the gutter.

SUMMARY OF THE INVENTION

The present invention satisfies the need of hydrodynamic and wipe cleaning of the printing nozzles on the print head without the necessity of removing the gutter.

An object of the invention is to provide a hydrodynamic and wipe cleaning system wherein the print head incorporates integrated hydrodynamic cleaning fluid delivery nozzles.

Another object of the invention is to provide a hydrodynamic and wipe cleaning system having a side entry wiper that is incorporated in the maintenance station.

Still another object of the invention is to provide a hydrodynamic and wipe cleaning system having a side entry wiper that is attached to the print head.

Still another object of the invention is to provide a hydrodynamic and wipe cleaning system having a spittoon to collect cleaning fluid at the maintenance station.

Further objects and advantages of the invention will be brought out in the following portions of the specification, wherein the detailed description is for the purpose of fully disclosing preferred embodiments of the invention without placing limitations thereon.

The present invention provides the advantage of an integrated cleaning fluid delivery means incorporated into the print head, along with precision wiper positioning on the print head, which functions effectively in cleaning the printing nozzles, while using existing print head translation mechanisms.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 7B. It will be appreciated that the apparatus may vary as to configuration and as to details of the parts without departing from the basic concepts as disclosed herein.

Figure 1:
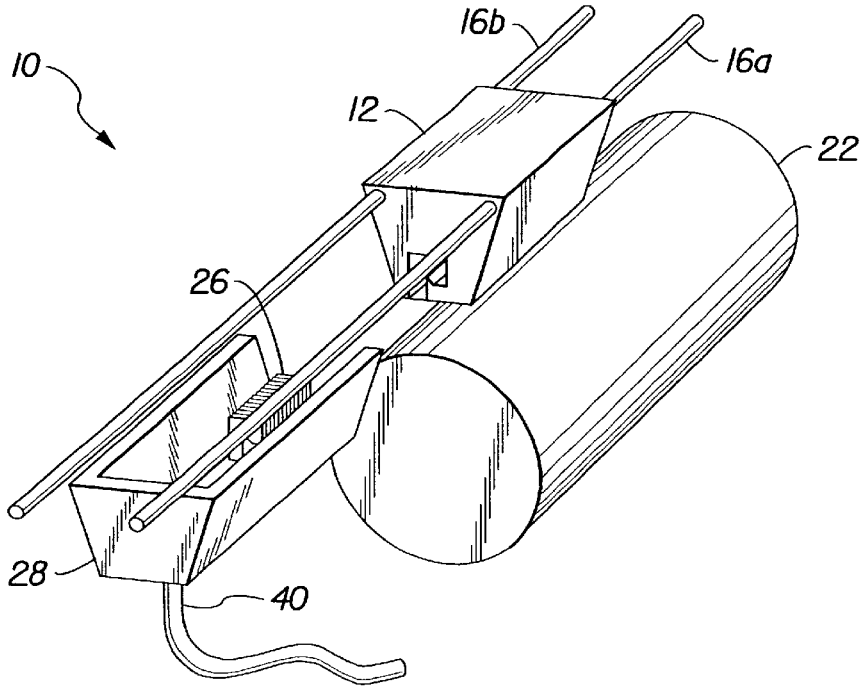
FIG. 1. is a perspective view of a print head along with a wiper and spittoon, in accordance with the present invention, shown in relation to a print drum.
Figure 2:
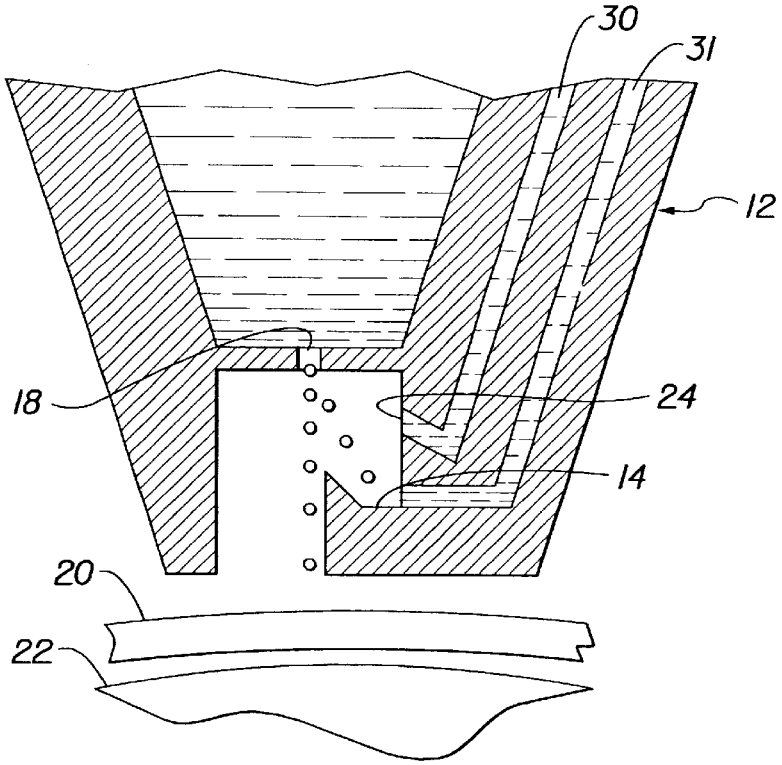
FIG. 2 is a cross-sectional view of a print head shown in FIG. 1.

Referring to FIG. 1 and FIG. 2, a continuous ink jet printer maintenance or cleaning system 10 in accordance with the present invention is generally shown. The continuous ink jet printer maintenance or cleaning system is adapted for use with a print head 12 having a gutter 14. Print head 12 translates along guide shafts 16*a* and 16*b* during printing, as well as for maintenance and cleaning. During printing, ink is discharged from an ink nozzle 18 in print head 12 onto a print media 20, which is disposed adjacent a print drum 22. Continuous ink jet printer maintenance or cleaning system 10 generally comprises a hydrodynamic cleaning fluid nozzle 24, a wiper 26, and a spittoon 28.

Hydrodynamic cleaning fluid nozzle 24 is disposed within print head 12 such that cleaning fluid discharged from hydrodynamic cleaning fluid nozzle 24 is directed towards ink nozzle 18. Hydrodynamic cleaning fluid nozzle 24 is in fluid communication with a manifold or fluid channel 30 that supplies pressurized cleaning fluid to hydrodynamic cleaning fluid nozzle 24. It is also contemplated that cleaning fluid may be delivered to nozzles through the gutter/ink recirculation system 31. The cleaning fluid can be water, solvent, or a combination of both, depending on the type of ink used. Those skilled in the art will appreciate that print head 12 can be configured with a plurality of hydrodynamic cleaning fluid nozzles 24 when print head 12 has a plurality of ink nozzles 18. Hydrodynamic cleaning fluid nozzles 24 may be supplied with cleaning fluid from a reservoir (not shown) through either a single manifold or individual fluid channels. The pressurization of the reservoir to discharge cleaning fluid from cleaning fluid nozzle 24 on demand is accomplished by the actuation of a solenoid (not shown) when print head 12 moves over spittoon 28.

Figure 3:
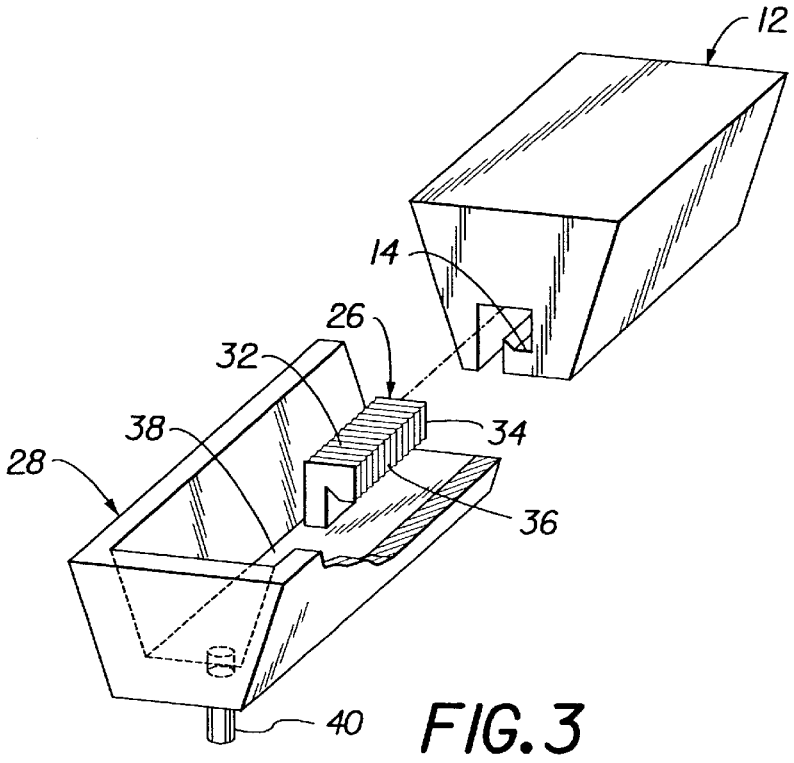
FIG. 3 is a sectional view, in perspective, of a print head along with a wiper and spittoon, shown in FIG. 1.
Figure 4:
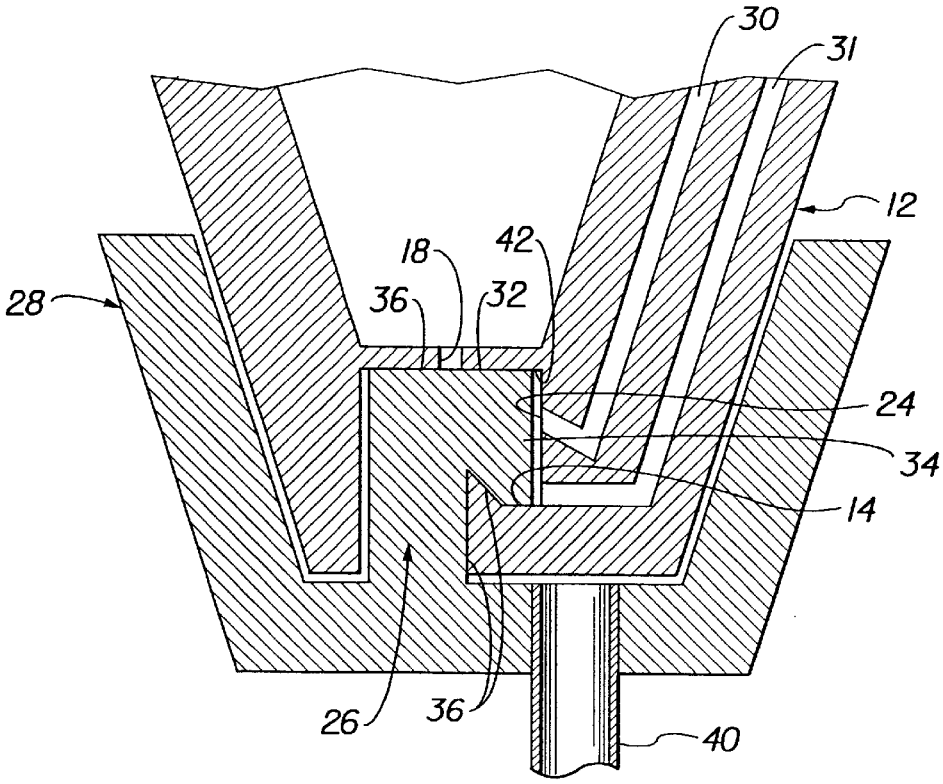
FIG. 4 is a cross-sectional view of a wiper and spittoon shown in FIG. 1, with the print head engaged therein.

Referring now to FIG. 3 and FIG. 4, wiper 26 is adapted to slidably engage print head 12 for cleaning ink nozzle 18 and gutter 14. Wiper 26 includes an upper surface 32 and a laterally extending member 34, and is preferably fabricated from a compliant yet durable material, such as rubber, silicone, or the like. Wiper 26 may also incorporate a plurality of transversely disposed ribs 36 to enhance its cleaning effectiveness. A stiffener (not shown) also can be employed on wiper 26.

Spittoon 28 is positioned along the path of guide shafts 16*a* and 16*b*, such that print head 12 engages spittoon 28 during the translation of print head 12 beyond print drum 22. Spittoon 28 includes a basin 38 and a drain 40 therein. Basin 38 is shaped to bias the flow of liquid towards drain 40. In the preferred embodiment of the present invention, wiper 26 is affixed within spittoon 28 for engagement with print head 12.

To clean ink nozzle 18 and gutter 14 of print head 12, print head 12 slides along guide shafts 16*a* and 16*b* over and into spittoon 28. As print head enters spittoon 28, wiper 26 engages gutter 14 of print head 12 and translates relative to print head 12. Wiper 26 is typically self-aligning within gutter 12. Cleaning fluid is concurrently discharged towards ink nozzle 18. The continual motion of print head 12 causes upper surface 32 of wiper 26 to slide along a nozzle plate 42 of print head 12 and laterally extending member 34 to slide along gutter 14. As wiper 26 translates relative to print head 12, hydrodynamic wipe cleaning of print head 12 is achieved over spittoon 28 due to the simultaneous discharge of cleaning fluid from cleaning fluid nozzle 24 towards ink nozzle 18, which creates a high shear force and high flow of cleaning fluid across the face of nozzle plate 42. Cleaning fluid, which also serves to wet wiper 26, is collected in basin 38 and directed to drain 40. Drain 40 routes the cleaning fluid back to the reservoir for recirculation. After print head 12 reaches the end of travel, it returns towards print drum 22 causing another relative translation of wiper 26 over nozzle plate 42 and gutter 12, thereby achieving another wipe cleaning of print head 12.

Figure 5:
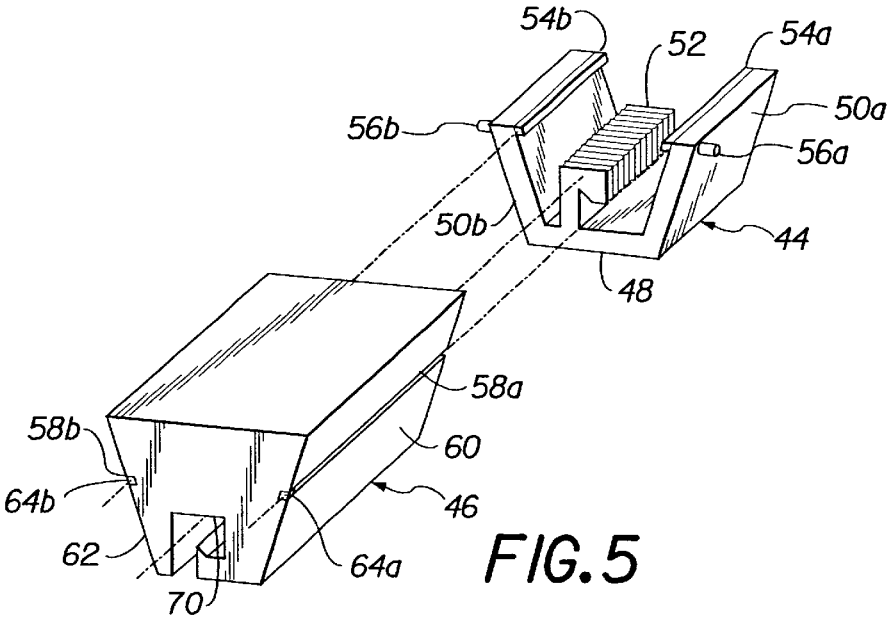
FIG. 5 is perspective view of a print head and wiper shuttle, in accordance with an alternate embodiment of the present invention, employing a wiper shuttle.

Referring also to FIG. 5, an alternative embodiment continuous ink jet printer maintenance or cleaning system 10 in accordance with the present invention is shown employing a wiper shuttle 44. In this embodiment, wiper shuttle 44 is slidably attached to print head 46.

Wiper shuttle 44 generally comprises a base 48, a pair of walls 50*a* and 50*b* extending upwardly from base 48, a wiper 52 affixed to base 48 between walls 50*a* and 50*b*, and a pair of tabs 54*a* and 54*b* that protrude inwardly from the upper end of walls 50*a* and 50*b*, respectively. Wiper shuttle 44 further includes pins 56*a* and 56*b* that protrude outwardly from the upper end of walls 50*a* and 50*b*, respectively.

Figure 6:
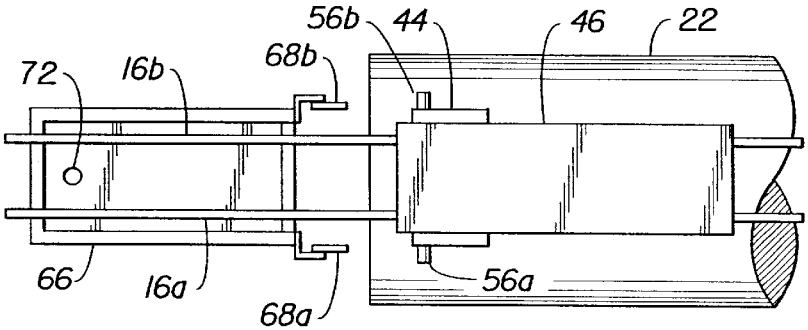
FIG. 6 is a top plan view of a print head and wiper shuttle shown in FIG. 5, shown in relation to a spittoon and a print drum.

Print head 46 includes a pair of grooves 58*a* and 58*b*, respectively disposed on the rear edge 60 and the front edge 62 of print head 46. Grooves 58*a* and 58*b* extend along the width of print head 46 with each having a mechanical stop 64*a* and 64*b* , respectively, at the end of grooves 58*a* and 58*b* closest to the spittoon 66, as can be seen in FIG. 6. Grooves 58*a* and 58*b* are configured to receive tabs 54*a* and 54*b* , respectively, of wiper shuttle 44, which is capable of sliding along the width of print head 46 and is restricted on one side of print head 46 by mechanical stops 64*a* and 64*b*. In order to maintain relatively tight tolerances between wiper shuttle 44 and print head 46, walls 50*a* and 50*b* of wiper shuttle 44 are configured to match the profile of print head 46 when wiper 52 is engaged within print head 46. In this alternative embodiment, print head 46 alignment over spittoon 66 is less critical since wiper 52 is already engaged within print head 46.

Figure 7A:
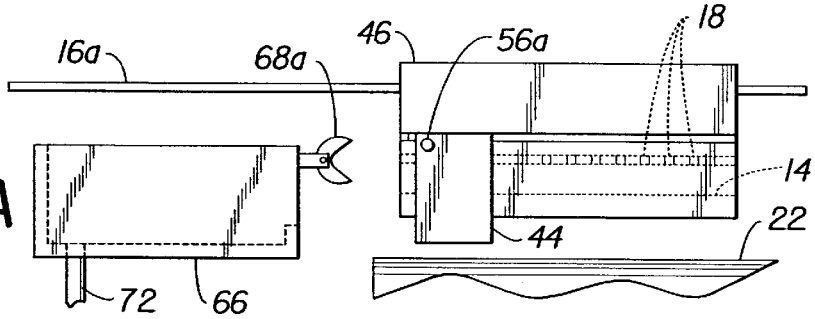
FIG. 7A is a side elevational view of a print head and wiper shuttle shown in FIG. 6, approaching a toggle on the spittoon.
Figure 7B:
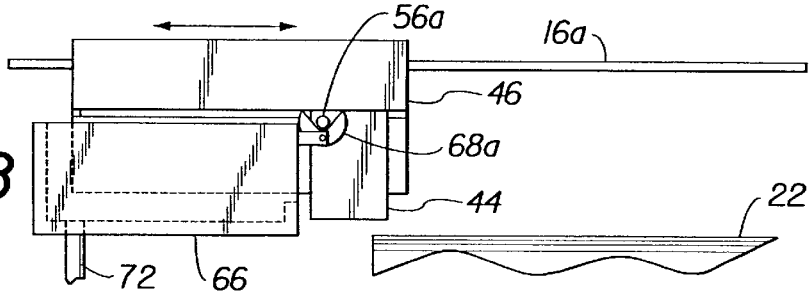
FIG. 7B is a side elevational view of a print head and wiper shuttle shown in FIG. 7A, engaging a toggle on the spittoon.

Referring now to FIG. 6 to FIG. 7B, spittoon 66 includes a pair of mechanical toggles 68*a* and 68*b* adjacent the end of spittoon 66 closest to print drum 22. When print head 46, with wiper shuttle 44 attached thereon, slides along guide shafts 16*a* and 16*b* and approaches spittoon 66, pins 56*a* and 56*b* engage mechanical toggles 68*a* and 68*b*, respectively, causing wiper shuttle 44 to effectively stop. When pins 56*a* and 56*b* engage mechanical toggles 68*a* and 68*b*, mechanical toggles 68*a* and 68*b* also activate a solenoid (not shown) which pressurizes reservoir and discharges cleaning fluid towards nozzle plate 70 of print head 46. Print head 46, however, continues to slide unabated over spittoon 66, thereby causing relative translational motion between wiper 52 and nozzle plate 70. This relative translational motion between wiper 52 and nozzle plate 70, along with the discharge of cleaning fluid, results in hydrodynamic wipe cleaning of print head 46.

The cleaning fluid is directed to a drain 72 in spittoon 66, and drain 72 routes the cleaning fluid back to the reservoir for recirculation. After print head 46 reaches the end of travel over spittoon 66, it returns towards print drum 22. During this return process, wiper shuttle 44, which is still stationary, causes relative translation of wiper 52 over nozzle plate 70, resulting in another wipe cleaning of print head 46. As print head 46 moves away from spittoon 66, tabs 54*a* and 54*b* of wiper shuttle 44 are restricted by mechanical stops 64*a* and 64*b* , respectively, thereby also withdrawing wiper shuttle 44 away from spittoon 64.

Accordingly, it will be seen that this invention provides for the precision hydrodynamic and wipe cleaning of a print head having a gutter, while using existing print head translation mechanisms, without the necessity or inconvenience of removing the gutter.

Although the description above contains many specificities, these should not be construed as limiting the scope of the invention but as merely providing illustrations of some of the presently preferred embodiments of this invention. Thus the scope of this invention should be determined by the appended claims and their legal equivalents.

PARTS LIST

| | |
|---|---|
| 10 | print head maintenance or cleaning system |
| 12 | print head |
| 14 | gutter |
| 16a/b | guide shafts |
| 18 | ink nozzle |
| 20 | print media |
| 22 | print drum |
| 24 | cleaning fluid nozzle |
| 26 | wiper |
| 28 | spittoon |
| 30 | manifold or fluid channel |
| 31 | gutter/ink recirculation system |
| 32 | upper surface of wiper |
| 34 | laterally extending member |
| 36 | ribs |
| 38 | basin |
| 40 | drain |
| 42 | nozzle plate |
| 44 | wiper shuttle |
| 46 | print head |
| 48 | base |
| 50a/b | walls |

-continued

| PARTS LIST | |
|---|---|
| 52 | wiper |
| 54a/b | tabs |
| 56a/b | pins |
| 58a/b | grooves |
| 60 | rear edge |
| 62 | front edge |
| 64a/b | mechanical stops |
| 66 | spittoon |
| 68 | mechanical toggles |
| 70 | nozzles plate |
| 72 | drain |

What is claimed is:

1. A continuous ink jet printer maintenance or cleaning system for a print head having an ink nozzle, the print head including a gutter, the print head movable along guide shafts, comprising:

a hydrodynamic cleaning fluid nozzle within said print head;

a wiper simultaneously engageable with said print head and said gutter, whereby relative translational movement between said wiper and said print head, along with a discharge of cleaning fluid from said hydrodynamic cleaning fluid nozzle, cleans said ink nozzle of said print head; and a spittoon for collecting discharged cleaning fluid, said spittoon positioned along said guide shafts, whereby movement of said print head along said guide shafts positions said print head over said spittoon.

2. A maintenance or cleaning system as recited in claim 1, wherein said hydrodynamic cleaning fluid nozzle directs cleaning fluid toward said ink nozzle.

3. A maintenance or cleaning system as recited in claim 1, wherein said spittoon further comprises a drain for removal of discharged cleaning fluid.

4. A maintenance or cleaning system as recited in claim 1, wherein said wiper includes a plurality of ribs.

5. A maintenance or cleaning system as recited in claim 1, wherein said wiper is disposed on said spittoon.

6. A maintenance or cleaning system as recited in claim 1, further comprising:

a wiper shuttle, said wiper disposed on said wiper shuttle, said wiper shuttle including a pair of tabs; and a pair of grooves disposed along said print head, said grooves adapted to receive said tabs of said wiper shuttle, whereby said wiper shuttle is slidably attached to said print head.

7. A maintenance or cleaning system as recited in claim 6, further comprising:

at least one toggle disposed on said spittoon; and at least one pin disposed on said wiper shuttle, said pin adapted to actuate said toggle when said print head approaches said spittoon, whereupon said wiper shuttle is held in place while said print head moves over said spittoon.

8. A maintenance or cleaning system as recited in claim 1, wherein relative translational movement between said wiper and said gutter occurs simultaneously with said relative translational movement between said wiper and said print head.

9. A continuous ink jet printer maintenance or cleaning system for a print head having an ink nozzle and a gutter, the print head movable along guide shafts, comprising:

a hydrodynamic cleaning fluid nozzle within said print head;

a spittoon for collecting discharged cleaning fluid, said spittoon positioned along said guide shafts, whereby movement of said print head along said guide shafts positions said print head over said spittoon; and a wiper for engaging said print head, said wiper disposed on said spittoon, wherein translational movement of said print head over said spittoon causes simultaneous translation of said ink nozzle over said wiper and of said wiper over said gutter.

10. A maintenance or cleaning system as recited in claim 9, wherein said hydrodynamic cleaning fluid nozzle directs cleaning fluid toward said ink nozzle.

11. A maintenance or cleaning system as recited in claim 9, wherein said spittoon further comprises a drain for removal of discharged cleaning fluid.

12. A maintenance or cleaning system as recited in claim 9, wherein said wiper includes a plurality of ribs.

13. A continuous ink jet printer maintenance or cleaning system for a print head having an ink nozzle and a gutter, the print head movable along guide shafts, comprising:

a hydrodynamic cleaning fluid nozzle within said print head;

a spittoon for collecting discharged cleaning fluid, said spittoon positioned along said guide shafts, whereby movement of said print head along said guide shafts positions said print head over said spittoon, a wiper shuttle, said wiper shuttle including a pair of tabs;

a pair of grooves disposed along said print head, said grooves adapted to receive said tabs of said wiper shuttle, whereby said wiper shuttle is slidably attached to said print head; and a wiper disposed on said wiper shuttle, said wiper adapted to engage said print head, whereby relative translation movement between said wiper and said print head, along with a discharge of cleaning fluid from said hydrodynamic cleaning fluid nozzle, cleans said ink nozzle of said print head.

14. A maintenance or cleaning system as recited in claim 13, further comprising:

at least one toggle disposed on said spittoon; and at least one pin disposed on said wiper shuttle, said pin adapted to actuate said toggle when said print head approaches said spittoon, whereupon said wiper shuttle is held in place while said print head moves over said spittoon.

15. A maintenance or cleaning system as recited in claim 13, wherein said hydrodynamic cleaning fluid nozzle directs cleaning fluid toward said ink nozzle.

16. A maintenance or cleaning system as recited in claim 13, wherein said spittoon further comprises a drain for removal of discharged cleaning fluid.

17. A maintenance or cleaning system as recited in claim 13, wherein said wiper includes a plurality of ribs.

18. An ink jet printer cleaning system comprising:

a print head having a nozzle plate;

a wiper shuttle slidably attached to said print head, said wiper shuttle being moveable between a first position and a second position; and a wiper disposed on said wiper shuttle operable to engage said nozzle plate as said wiper shuttle moves between said first position and said second position.

19. The ink jet printer cleaning system according to claim 18, wherein said print head has a profile, said wiper shuttle having walls configured to match said profile of said print head.

20. The ink jet printer cleaning system according to claim 18, wherein said print head includes a hydrodynamic cleaning fluid nozzle operable to discharge cleaning fluid.

21. The ink jet printer cleaning system according to claim 18, wherein said wiper is self-aligning within said print head.

22. The ink jet printer cleaning system according to claim 18, further comprising:

a spittoon, wherein said print head is moveable between a first position spaced apart from said spittoon and a second position substantially over said spittoon.

23. The ink jet printer cleaning system according to claim 18, wherein said printhead includes a gutter, said wiper being operable to simultaneously engage said gutter while engaging said nozzle plate.

* * * * *